United States Patent [19]

Kreinin et al.

[11] 4,036,298

[45] July 19, 1977

[54] METHOD OF CONNECTION OF WELLS BY IN-SITU COMBUSTION

[76] Inventors: Efim Vulfovich Kreinin, Starye Kuzminki 127a Kvartal, 9b, kv. 69; Kirill Nikolaevich Zvyagintsev, ulitsa Dolgoprudnaya, 13a, kv. 51, both of Moscow, U.S.S.R.

[21] Appl. No.: 603,820

[22] Filed: Aug. 12, 1975

[30] Foreign Application Priority Data

Aug. 21, 1974 U.S.S.R. ..... 2056358

[51] Int. Cl.[2] ..... E21C 43/00

[52] U.S. Cl. ..... 166/251; 166/256; 175/12

[58] Field of Search ..... 48/DIG. 6; 166/250, 166/251, 252, 256, 263, 272; 299/4; 175/12

[56] References Cited

U.S. PATENT DOCUMENTS

| | | | |
|---|---|---|---|
| 2,841,375 | 7/1958 | Salomonsson | 166/256 |
| 2,923,535 | 2/1960 | Ljungstrom | 166/256 |
| 3,032,103 | 5/1962 | Parker | 166/256 |
| 3,298,434 | 1/1967 | Graham | 166/251 |
| 3,563,606 | 2/1971 | Sears | 175/12 |

OTHER PUBLICATIONS

Wilkins, "The Underground Gasification of Coal", The Gas World, 11/25/44, pp. 545–550.

Thring, "Underground Gasification of Coal", Mining Congress Journal, 9/44, pp. 37, 38 & 52.

Jolley et al., "The Underground Gasification of Coal", Fuel in Science and Practice, vol. XXIV, No. 2, pp. 31–36.

*Primary Examiner*—Ernest R. Purser

[57] ABSTRACT

A method of mine-less connection of wells for underground gasification by the filtrational fire connecting technique is intended primarily for forming a single unitary gasification channel for underground gasification of coal, oil shale and oil-bearing beds. In the disclosed method of connecting wells or boreholes drilled for underground gasification, the coal bed is ignited in one of the wells situated in the direction of formation of the unitary gasification channel. After a center of combustion has been set in this well, an air blast is directed at a permanent flow rate into the well with which the connection is to be effected. The pressure of the air blast charged into the well is measured, and when the pressure drops considerably, an air blast is charged for connection purposes into the next successive well in the direction of formation of the gasification channel. The disclosed method provides for maintaining the combustion source in the area of the well connected with the gasification channel and thus for ensuring reliable formation of the unitary single gasification channel.

3 Claims, 5 Drawing Figures

METHOD OF CONNECTION OF WELLS BY IN-SITU COMBUSTION

BACKGROUND OF THE INVENTION

The present invention relates to methods of mineless connection of wells for underground gasification and, more particularly, to methods of filtrational fire connection.

The herein disclosed method of connection can be successfully utilized for underground gasification of coal, when a unitary gasification channel has to be formed.

In addition, the present invention can be utilized for underground gasification of oil and kerosene shale and of oil-bearing beds.

There are known techniques of filtrational fire connection of wells, viz. the direct-flow technique and the counter-flow technique.

In the direct-flow technique, the coal bed is ignited in one of the wells intended for performing underground gasification of this coal bed, and a center of combustion is set. To connect the well in which the coal bed is ignited with the next successive well in the direction of formation of the unitary gasification channel, a blast of air is directed into the first-mentioned well. The blast may contain either ambient air or air enriched with oxygen. As a result, the zone of combustion starts expanding, owing to gassing out of the coal bed. Gassing out of the coal bed develops in accordance with the laws defining the paths of the blast of the gas through the body of the coal bed, depending on the direction and prevailing location of natural cracks. fissures and pores of the coal bed, with the outline of the gassed-out space elongating in the direction of these prevailing locations. More often than not this direction does not coincide with the required of formation of the gasification channel, and great quantities of coal are gassed out in order to effect connection of the two wells, which involves a waste of energy spent on maintaining the blast directed into the well.

Thus, a disadvantage of the direct-flow filtrational fire connection technique is the low intensity of formation of the gasification channel and the waste of the air blast. Another disadvantage of this technique is its poor directability, because gassing out of the coal bed takes place in the direction of the prevailing location of the fissures and pores of the coal bed.

On account of these disadvantages of the direct-flow filtrational fire connection technique, the technique of counter-flow filtrational fire connection has been recently utilized on an ever-increasing scale. In the counter-flow filtrational fire connection technique the coal bed is ignited in one of the wells to be connected, and a combustion center is set. The air blast is directed under pressure into the other well which is to be connected with the first-mentioned one. Owing to the presence of natural fissures and pores in the coal bed, the air blast directed into the well starts propagating through the coal bed in every direction according to the rules defined by the physical properties of the coal bed, such as its gas permeability, the presence of fissures, and the quantity of water in the coal bed. A portion of the blast propagating through the bed reaches the center of combustion, the oxygen contained in the blast reacts with the incandescent coal, and the heat thus produced heats the coal adjacent to the fire face on the side from which the blast has approached the combustion zone and ignites this coal. In this way the combustion zone advances in the direction of the propagation of the blast through the coal bed. Owing to the air blast being charged into the bed, the combustion zone advances through the coal bed until it reaches the well into which the blast is charged. The moment the combustion zone reaches the well into which the blast is charged, the pressure in this well drops considerably, usually, to 1 to 3 atm. gauge. This pressure drop indicates that the wells have been connected. When the wells have been connected, the coal gasification process is commenced.

To extend the initially formed gasification channel in the required direction, an air blast is charged into the next successive well in the required direction. When the latter has been connected with the previously formed channel, the well is operated for gasification, and the connecting blast is charged into the next successive well. In the required way a gasification channel is formed in the required direction.

It should be noted that the air blast for connecting a successive well with the already formed gasification channel is started after the preceding well has engaged in the gasification process. Since, as has been stated hereinabove, the operation of connecting the wells is accompanied by the pressure dropping in the wells to 1–3 atm. gauge, the inflow of underground water contained in the coal bed sharply increases at the moment of connection, which often results in the combustion center being extinguished. Besides, after the successive connected well has been engaged in the gasification process, the volume of the air blast charged thereinto is increased to provide for gasification of the coal bed. These two factors lead to extermination of the combustion center directly in the well with which connection has been effected because this combustion center is displaced into other areas of the gassed-out coal bed. This extermination, in its turn, impairs connection of the already formed gasification channel with the next successive well, since the combustion zone starts advancing not from the preceding well, but from more remote areas of the gassed-out coal bed. Thus, the process of connection of the wells becomes more time-consuming, and the volume of the blast which is to be charged to effect the connection is substantially increased. There are cases when the combustion center travels so far that connection of the wells becomes altogether impossible, and, therefore, it is impossible to form a unitary gasification channel. In such cases it becomes necessary to drill additional dewatering wells to dry the gasification areas.

Thus, among the disadvantages of the above described technique are its insufficient reliability in forming unitary gasification channel and its increased consumption of the air blast charged to effect connection.

SUMMARY OF THE INVENTION

It is an object of the present invention to eliminate the disadvantages inherent in the known techniques for fire connection of wells.

It is another object of the present invention to provide for the reliable formation of a unitary gasification channel with a minimum waste of the blast charged to effect connection of the wells.

These and other objects are attained in a method of connection of wells for underground gasification by the filtrational fire connection technique, including igniting the coal be in one of the wells to be connected by the gasification channel; directing a blast at a permanent flow rate into the well with which connection is to be effected; upon the creation of the combustion center measuring the pressure of the blast directed into the well; directing a blast into the next successive well in the direction of formation of the gasification channel when the pressure of the blast directed into the preceding well has dropped considerably.

In the case of coal beds with a gas permeability factor up to 0.05 darcy, it is expedient that the blast directed into the next successive well in the direction of formation of the gasification channel be initiated upon the pressure in the preceding well dropping by 20 to 25 percent. In the case of coal beds with a gas permeability factor up to 1.0 darcy it is expedient that the blast directed into the next successive well in the direction of formation of the gasification channel be initiated upon the pressure in the preceding well dropping by 40 to 50 percent.

BRIEF DESCRIPTION OF THE DRAWINGS

The present invention will be further described in connection with an embodiment thereof, with reference being had to the accompanying drawings, wherein.

DETAILED DESCRIPTION OF PREFERRED EMBODIMENT

The herein disclosed method is effected, as follows.

Figure 1:
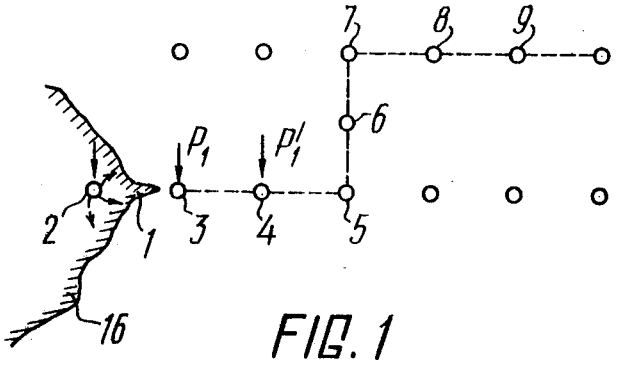
FIG. 1 illustrates a portion of a gas generator wherein the gasification channel is formed by the gassed-out portion of the coal bed.

Let us presume that it is necessary to produce a gasification channel 1 (FIGS. 1 and 2) over a portion of a gas generator in a direction indicated in the drawings with a dash line; in other words, it is necessary to connect wells 2 to 9 (FIG. 1) or wells 10 to 15 (FIG. 2) with a gasification channel.

Figure 2:
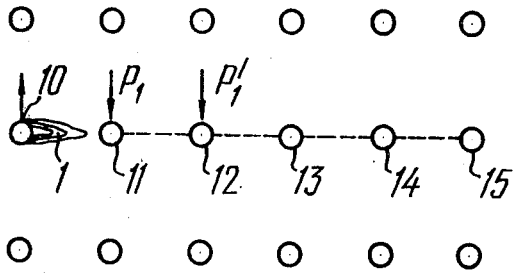
FIG. 2 shows a portion of the gas generator wherein the gasification channel is produced by the coal bed ignited in the well.

Two somewhat different cases are possible, viz. one when the gasification channel is to be formed from the operating part of the gas generator, i.e., from the gassed-out space 16 (FIG. 1), and the other when the gasification channel 1 is to be formed between wells, e.g. wells 10–11, of the part of the gas generator prepared for gasification (FIG. 2). In the first case a blast for connection of the wells 2 and 3 is directed into the well 3, adjacent to the gassed-out space in the required direction of formation of the gasification channel. In the second case the coal bed is ignited in the first one of the wells to be connected, i.e., in the well 10, and upon the combustion center having been set a blast is directed into the next successive well 11 in the direction of formation of the gasification channel.

Figure 3:
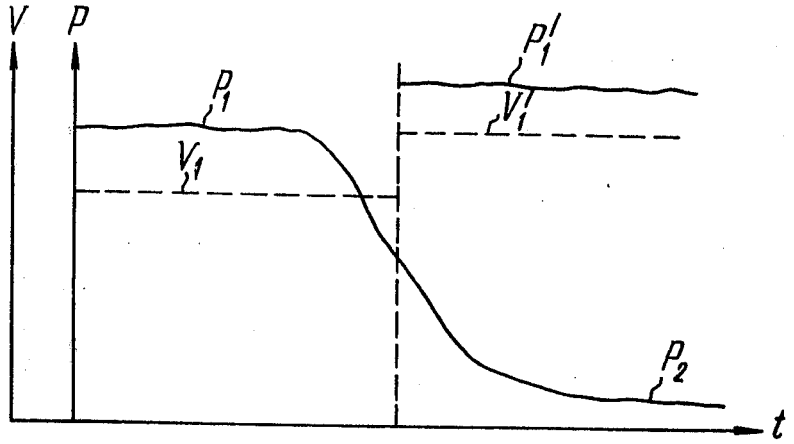
FIG. 3 presents a curve of variation of the pressure of the blast directed into the well vs. time.

In both cases the blast is directed into the wells at a pressure $P_1$ and at a permanent rate $V_1$ (FIG. 3). The Y axis of the plot shows the rate V in $m^3/hr$, pressure P in atmospheres, while the X axis shows time $\tau$ per 24 hrs. The value of the pressure $P_1$ depends on the depth of the location of the coal bed, on the gas permeability thereof and on the amount of water therein. An optimal value of the rate $V_1$ depends on the distance between the wells. The greater the spacing of the wells, the greater the rate $V_1$ should be. In practice, with the wells spaced by up to 20 meters, the rate $V_1$ should not be below 200 to 300 $m^3$/hour.

With the blast directed into either the well 3 or the well 11, the blast propagates into the coal bed via the system of natural fissures and pores in every direction and a portion of the blast reaches the combustion zone. Then the combustion zone starts advancing in opposition to the propagation of the blast thereto, i.e., toward the well 3 or toward the well 11 into which the blast is directed for connection purposes.

With the combustion zone approaching the well 3 or the well 11 into which the blast is directed, the pressure $P_1$ of the blast drops, as illustrated by the curve in FIG. 3. The pressure drop is explained by the fact that the thickness of the coal bed intermediate the well 3 or the well 11 and the combustion zone diminishes, and the permeability of this portion of the coal bed to the blast directed into the well 3 or the well 1 diminishes correspondingly. The distance between the well 3 or the well 11 and the combustion zone, at which the drop of the pressure of the connecting blast occurs, depends on the gas permeability of the coal bed, this distance becoming smaller as the gas permeability factor of the coal bed is lowered.

Upon the pressure of the blast directed into the well 3 or the well 11 having dropped considerably, a blast at a pressure $P_1'$ and a rate $V_1'$ is initiated in the next successive well in the direction of formation of the gasification channel, i.e., in the well 4 or in the well 12. In case of coal beds housing a gas permeability factor up to 0.05 darcy the blast is directed into the successive well upon the pressure in the preceding well having dropped by 20 to 25 percent, which pressure drop distinctly indicates that the combustion zone has approached the well 3 or the well 11.

In case of coal beds having a gas permeability factor up to 1.0 darcy the blast is directed into the successive well 4 or 12 upon the pressure in the preceding well having dropped by 40 to 50 percent. On account of the greater gas permeability of the coal beds of this latter type the drop of the pressure of the blast directed into the preceding well 3 or 11 begins long before the combustion zone actually reaches the well, whereby it is necessary to let the combustion zone approach the well 3 or the well 11 and only then to initiate the blast in the successive well, i.e., into the well 4 or in the well 12.

Upon the blast having been initiated in the next successive well in the direction of formation of the gasification channel, i.e., in the well 4 or the well 12, there reaches the combustion zone the blast from the preceding well 3 or 11, which is yet to be connected with the gasification channel 1 being formed, and the blast from the well 4 or from the well 12, into which the blast has been already initiated. Therefore, upon the combustion zone having reached the well 3 or the well 11, i.e., upon the well 3 or the well 1 having been connected with the gasification channel 1, the combustion zone continues its advance in opposition to the blast coming from the successive well 4 or 12 to be connected. Now the blast is directed into the well 3 or into the well 11, already connected with the gasification channel, at a pressure and at a rate necessary for the gasification purposes. The gasification of the channel 1 which has already formed commences while the combustion zone continues advancing in the required direction.

Consequently, in the course of formation of the gasification channel by the herein disclosed method there are no time intervals between the completion of connection of the well 3 or 11 and the initiation of the blast into the successive well in the direction of formation of the gasification channel, i.e., in the well 4 or 12. Since the combustion zone continously advances in the required direction, the possibility of its being either flooded or extinguished is prevented. Thus, it becomes possible to produce a unitary gasification channel 1 with a minimum waste of the blast. Furthermore, the herein disclosed method allows the gasification channel 1 to be completed in strict accordance with the distance between the wells and with the physical properties of the coal bed. This in its turn, permits careful planning in advance of the work of preparation of a coal bed for gasification.

Figure 4:
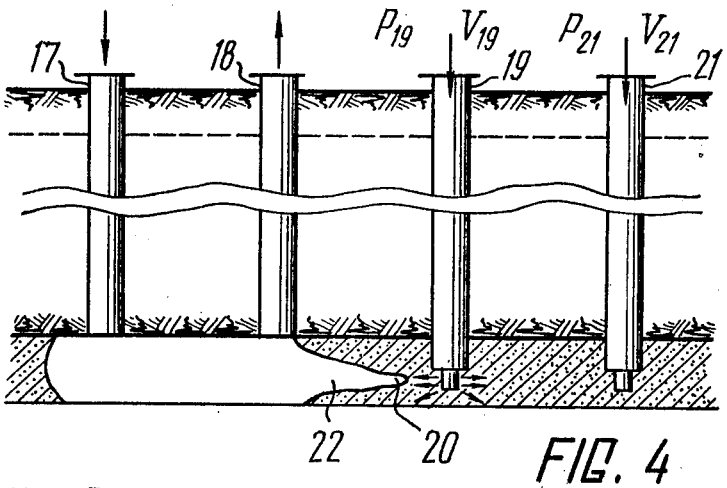
FIG. 4 is a vertical sectional view of a gas generator with a partly gassed-out coal bed.
Figure 5:
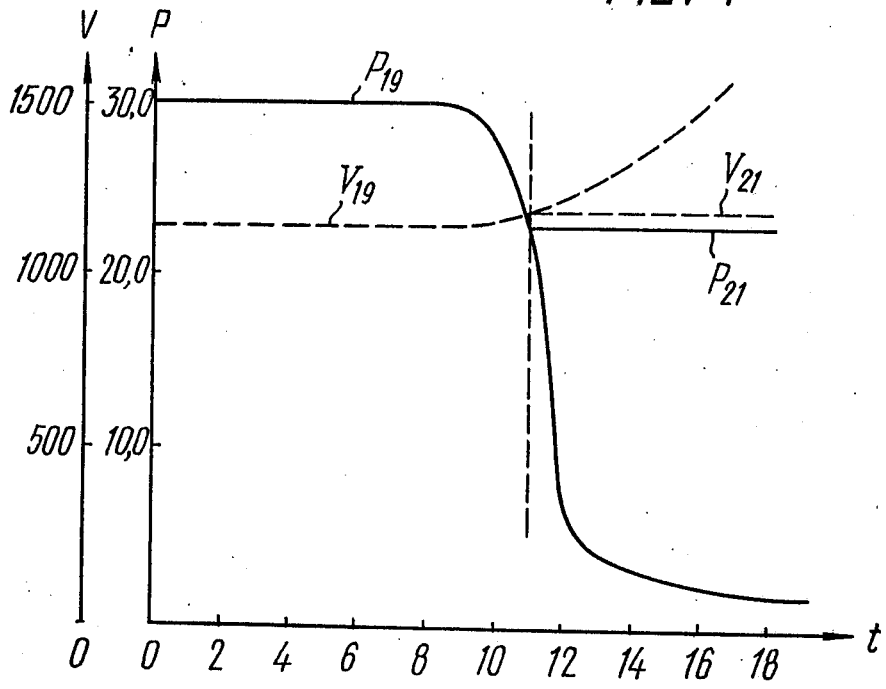
FIG. 5 presents a curve of variation of the pressure of the blast directed into the well vs. time, obtained during industrial testing of the disclosed method.

There is illustrated in FIG. 4 a vertical sectional view of a portion of a gas generator at which the herein disclosed method was tested. A blast was directed into a well 17 for gasification purposes, and the gas produced was withdrawn from a well 18. A blast for connection of the well 18 with a well 19 was directed into the well 19 at a pressure $P_{19}$ and a rate $V_{19}$ (FIG. 5). The Y axis of the plot shows the rate V in $m^3$/hr, pressure P in atmospheres, while the X axis shows time $\tau$ per 24 hrs. When the combustion zone 20 approached the well 19, the pressure $P_{19}$ started dropping, as can be seen from the curve in FIG. 5. When the pressure $P_{19}$ dropped in the well 19 by 20 to 25 percent, a blast was directed into a well 21 at a pressure $P_{21}$ and a rate $V_{21}$. It can be seen from the curve in FIG. 5 that while the combustion zone 20 was approaching the well 19 the pressure $P_{19}$ in this well was falling and the flow rate $V_{19}$ was increasing.

Blast was directed into the well 19 at the pressure $P_{19}$ = 30 atm. gauge and at the rate $V_{19}$ 32 1100 $m^3$/hour, and the combustion zone 20 was moving the well 18 toward the well 19. In 9.5 days the pressure in the well 19 started falling, which meant that the combustion zone 20 was approaching the well 19. When the pressure of the blast in the well 19 dropped to 23 atm. gauge, a blast was directed for connection purposes into the well 21. This enabled the preservation of the combustion zone 20 in the vicinity of the well 19 upon its connection with the already formed gasification channel 22, and the combustion zone immediately started moving toward the well 19. The well 19 was engaged in the gasification process, i.e., there was directed therein a gasification blast at a pressure of 1.5 atm. gauge and a flow rate up to 3,200 $m^3$/hour.

As a result of the utilization of the herein disclosed method, connection of the well 19 was effected in preplanned time at a rate of 2.1 m/day, with the blast rate equalling 1120 $m^3$/hour, and with the distance between the wells 18 and 19 equalling 19.5 m. Thus, the disclosed method provides for reliable connection of wells and for formation of a gasification channel within a minimum time and without unnecessary waste of the blast.

What is claimed is:

1. A method of mine-less connection of a series of first, second, third and successive wells for underground gasification via a unitary gasification channel by the fire infiltration technique, comprising the steps of: setting a combustion center by igniting the mineral bed in a first well to be connected by the gasification channel; forcing a gaseous, oxygen-containing blast at a permanent flow rate into a second well; measuring the pressure of the blast forced into the second well; and forcing a gaseous, oxygen-containing blast into a third well upon the pressure of the blast in the second well dropping considerably, each of the wells being disposed adjacent the preceding well in the series and in the direction of formation of the gasification channel.

2. The method of claim 1, wherein for mineral beds having a gas permeability factor up to 0.05 darcy the blast is forced into the third well in the direction of formation of the gasificaton channel upon the pressure in the second well dropping by 20 to 25 percent.

3. The method of claim 1, wherein for mineral beds having a gas permeability factor up to 1.0 darcy the blast is forced into the third well in the direction of formation of the gasification channel upon the pressure in the second well dropping by 40 to 50 percent.

* * * * *